United States Patent [19]

Ray

[11] Patent Number: 5,046,897

[45] Date of Patent: Sep. 10, 1991

[54] PLATFORM SUPPORT SYSTEM

[76] Inventor: Kenneth B. Ray, 87 Java Street, Ottawa, Ontario K1Y 3L5, Canada

[21] Appl. No.: 585,632

[22] Filed: Sep. 20, 1990

[30] Foreign Application Priority Data

Sep. 29, 1989 [CA] Canada ..... 614996

[51] Int. Cl.[5] ..... E02B 17/08

[52] U.S. Cl. ..... 405/221; 52/126.7

[58] Field of Search ..... 405/196, 218, 221; 52/122.1, 125.1, 126.1, 126.5, 126.7; 182/141, 142; 254/98-100

[56] References Cited

U.S. PATENT DOCUMENTS

| | | | |
|---|---|---|---|
| 907,645 | 12/1908 | Sauber | 405/221 |
| 2,140,617 | 12/1938 | Castady | 182/141 |
| 3,081,601 | 3/1963 | Fentiman | 405/221 |
| 4,343,570 | 8/1982 | Myer | 405/221 X |
| 4,417,426 | 11/1983 | Meng | 52/126.7 |
| 4,695,195 | 9/1987 | Brande | 405/221 X |

FOREIGN PATENT DOCUMENTS

| | | | |
|---|---|---|---|
| 660089 | 3/1963 | Canada . | |
| 598528 | 5/1969 | Canada . | |
| 1094896 | 5/1984 | U.S.S.R. | 405/221 |

OTHER PUBLICATIONS

Burston Manufacturing Co., Toronto, Ontario, Canada, Burston "Hurricane" Portable Adjustable Dock, six pages.

*Primary Examiner*—David H. Corbin

*Attorney, Agent, or Firm*—Charles P. Boukus, Jr.

[57] ABSTRACT

Disclosed is apparatus for raising and lowering a platform having wooden leg support means. A box girder is adapted to move axially about a wooden support leg of a platform, the box girder having means for securement of the girder to material forming the frame of a platform. The box girder has apertured lug on an exterior surface thereof. A header device is provided for detachable assembly with the top of a support leg of the platform during raising or lowering of the platform frame and screw means operationally cooperate with the header device and the girder lug for selectively raising or lowering the frame about the leg. Also disclosed is a method of using the apparatus in raising and lowering platform systems and has particular utility in dock systems.

20 Claims, 5 Drawing Sheets

PLATFORM SUPPORT SYSTEM

FIELD OF THE INVENTION

The invention pertains to a platform support system and more particularly to a support system including brackets and lifting hardware developed so that the platform may be installed and removed including raising and lowering the platform to selected heights. Although the concept of the invention is adaptable to various types of structures such as scaffolding, small bridges, patio decks, stages and performing platforms, the invention has particular utility in providing a dock system for boats and the like which can be installed and removed during cold weather, i.e. spring and fall without the necessity of entering the water.

BACKGROUND

Although the invention has wider application than docks or like structures, the description of the preferred embodiments of my invention relate to a docking system. Docks for boats and the like are common structures and have taken various shapes and configurations from those simplified docks built by hobbyists to those large articulated docks built for marinas and the like by professionals.

Canadian patent No. 598,528 granted relates to a dock system which is relatively simple and portably adjustable while the dock is in place, the level being adjustable to suit water levels. The dock sections of the above system are effectively suspended from chains connected to the head of posts and a specialized jack is used to lift the corner of each section and permit adjustment of the chain associated with said corner.

Although such vertically adjustable systems for docks are known, I have developed a system preferably adapted for use with wood supports which avoids chains and yet provides for selected water level adjustment, installation and removal without having to enter the cold water.

SUMMARY OF THE INVENTION

The invention broadly seeks to provide a system for raising and lowering platforms such as docks and yet is structurally strong and stable. In the environment of a dock system, the brackets and lifting system are constructed and used so that the dock can be installed and removed during cold weather, i.e. spring and fall without getting wet.

Preferably the dock is of an all wood structure because of durability and uniformity of appearance and pressure treated wood meets both these aspects with consumer confidence.

The dock may come in various sized sections with removable decks providing a wide range of possible variations in the final dock construction depending on and to meet the needs dictated by wind, wave action, water level fluctuation and accessibility for installation and removal.

The invention particularly provides bracket means which provide structural strength to the frame and legs. The lifting assembly associated with the brackets includes preferably a continuous coil threaded rod with lag nut and handle. Due to the coarse thread the lifting assembly does not bind and provides maximum lift per rotation.

Although a preferred embodiment of the invention pertains to dock systems, it is applicable to wider uses in the raising and lowering platforms including patio decks, stages, small bridges and the like.

In a broad aspect, the invention comprehends apparatus for raising and lowering a platform having wooden leg support means, comprising a box girder is adapted to move axially about a wooden support leg of a platform, the box girder having means for securement of the girder to material to be used in forming the frame of the platform, the box girder having lug means on an exterior surface thereof. Header means is provided for detachable assembly with the top of a support leg of the platform during raising or lowering of the platform frame to a desired level, and screw means is provided for operative association with the header means and the lug means for selectively raising or lowering the girder about the leg relative to the leg support means.

Another embodiment of the invention pertains to a method of raising or lowering a platform having a plurality of leg structures adapted for telescopic association with a plurality of box girders connected to frame members of a platform, each box girder having an apertured lug means associated therewith, and wherein the girders and leg structures may be detachably secured together at selected heights. The method includes the steps of connecting one end of a lag bolt to each girder lug means, telescopingly connecting the opposite threaded end of the lag bolt to a respective header plate associated with the top of each leg, connecting a nut assembly with the threaded end of the lag bolt, and rotating the nut assembly whereby the weight of the adjacent frame member is assumed by the associated leg structure.

DESCRIPTION OF PREFERRED EMBODIMENTS

Figure 1:
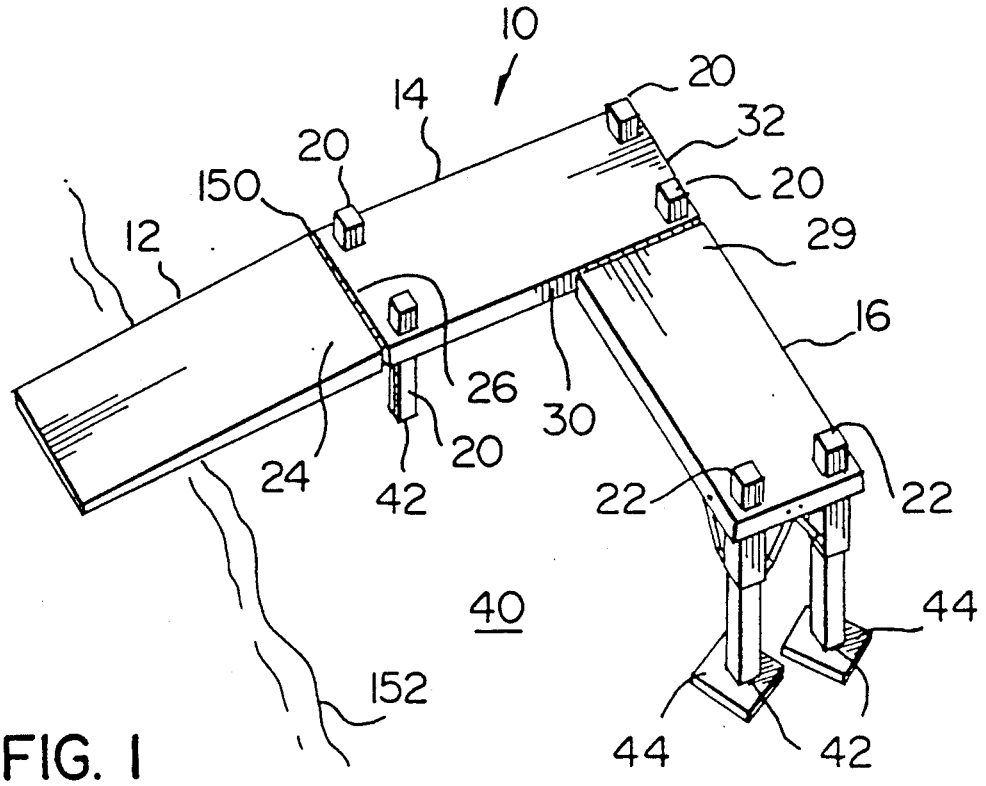
FIG. 1 is a perspective view of a dock system incorporating my invention.

FIG. 1 is a perspective view from above of a dock system 10 having ramp 12, first section 14 and second section 16. Section 14 includes four corner legs 20 whereas section 16 has two end corner legs 22. Outer end 24 of ramp 12 is bolted to inner end 26 of section 14 and inner end 28 of section 16 is bolted to a side 30 of section 16 adjacent its outer end 32.

It should be appreciated that the dock system depicted in FIG. 1 is only by way of illustration and various other configurations of the dock will be obvious without departing from the spirit of the invention. Legs 20 and 22 are preferably of 4×4 inch pressure treated wood directly contacting bottom 40. Under normal circumstances, the 11.5 square inch bearing surface of the bottom 42 of the legs is sufficient to support the dock section. However, if the bottom is very soft, the effective bearing surface on the bottom 40 can be increased using 2×2 ft. patio stones selectively located on the bottom. This variation is shown with legs 22 of section 16 using patio stones 44 located on bottom 40.

Figure 2:
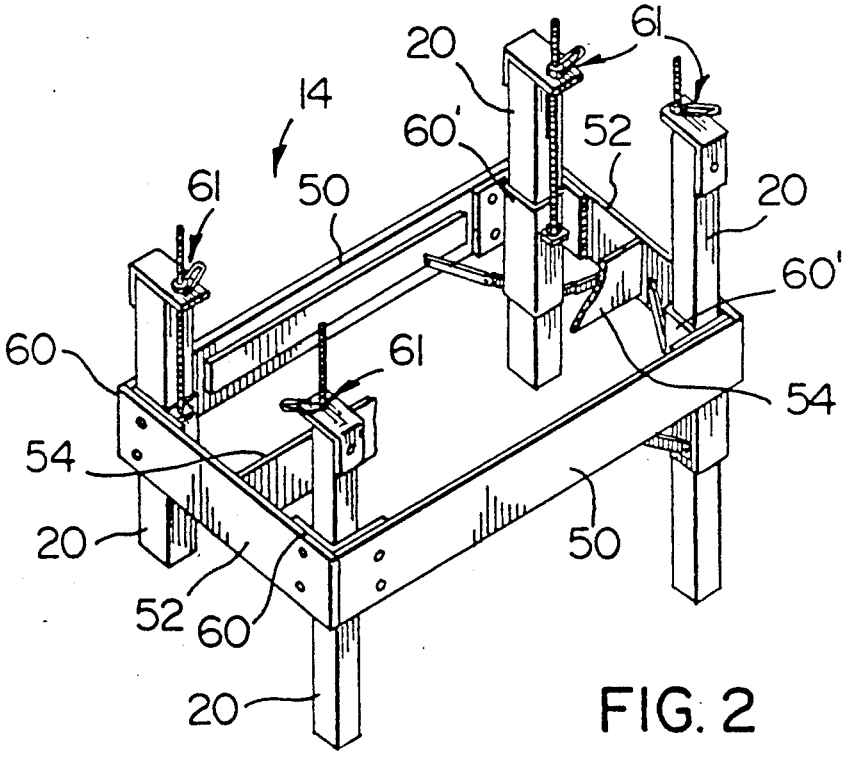
FIG. 2 is a perspective view of one section of the dock system shown in FIG. 1 with the planking removed.
Figure 3:
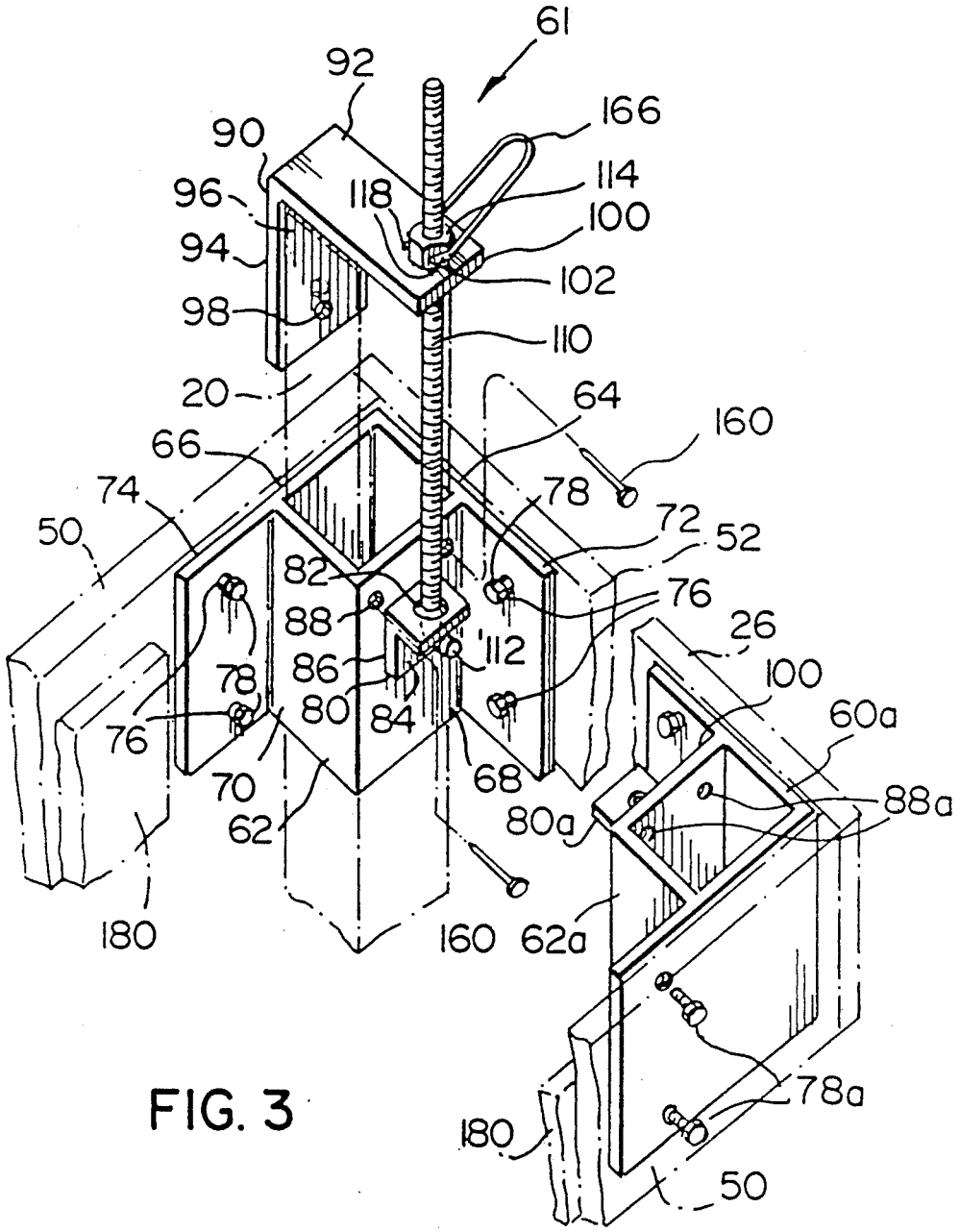
FIG. 3 is a perspective view of one of the brackets and lifting system.

FIG. 2 shows a perspective view of section 14 with the top surface planking removed. Section 14 comprises side frame members 50 and end frame members 52 with central support 54 between ends 52. Within each corner of the frame members 50 and 52 there is a metal bracket 60 or 60' comprising a box frame 62 through which leg 20 extends. Also shown in FIG. 2 is the lifting mechanism 61 for each leg as further detailed herein. As more particularly shown in FIG. 3, box frame 62 has outer adjacent sides 64 and 66 perpendicular to each other and adjacent inner sides 68 and 70 perpendicular to each other. Sides 64 and 66 have planar extensions or wings 72 and 74 respectively. Wings 72 and 74 each include a plurality of aperatures 76 with which carriage bolts 78 are associated and by which the brackets 60 are secured to side frame member 50 and end frame member 52. The inner side 68 of frame 62 has right angled lug 80 with aperture 82 in outwardly or laterally extending portion 84. Vertical lug portion 86 is suitably secured by welding or the like to side 68. Box frame 62 may be fabricated by metal plates welded or otherwise suitably secured together. It will be appreciated that lug 80 extends outwardly as shown in FIG. 3 from inner side 68 generally parallel with end member 52 and towards the other leg 20 at the other side of end 32 or 52 of dock section 14. The lug **80*a* which is secured to the box frame 62*a* of this other side leg is secured to inner side 70*a* in order to face lug 80. This will be appreciated from comparing bracket 80*a* shown in FIG. 3 with bracket 80. Above lug 80 are nail holes 88**, the purpose of which will become more apparent herein.

Also shown in FIG. 3 is the lifting mechanism 61 including header 90 which is of right angled construction having horizontal leg portion 92 and vertical leg portion 94. Leg portion 92 sits on top 94 of the 4"×4" (inch) leg 20 shown in dotted lines and leg portion 94 has aperture 98 for "tack nailing" connection with leg 20 during lifting as will become more apparent herein. Header leg portion 92 extends laterally in the same direction as lug 80 with extension portion 100 having aperture 102 therethrough. An identical header **90*a* (see FIG. 2) is associated with the other legs 20 and each is positioned so that aperture 102 is above the lug 80 or 80*a* of the associated support bracket 60 or 60*a***.

Lifting rod 110 is a continuous coil threaded rod with lower right angled end 112 and a cooperating lug nut 114 with integral handle 116. Handle 116 is formed of "U" shaped bar stock with ends 118 welded or otherwise secured to opposed sides of lug nut 114. Handle 116 is angled upwardly from the plane of lug nut 114 to facilitate rotation by hand, thus raising or lowering box frame 62 and attached frame members 50 and 52.

Figure 4:
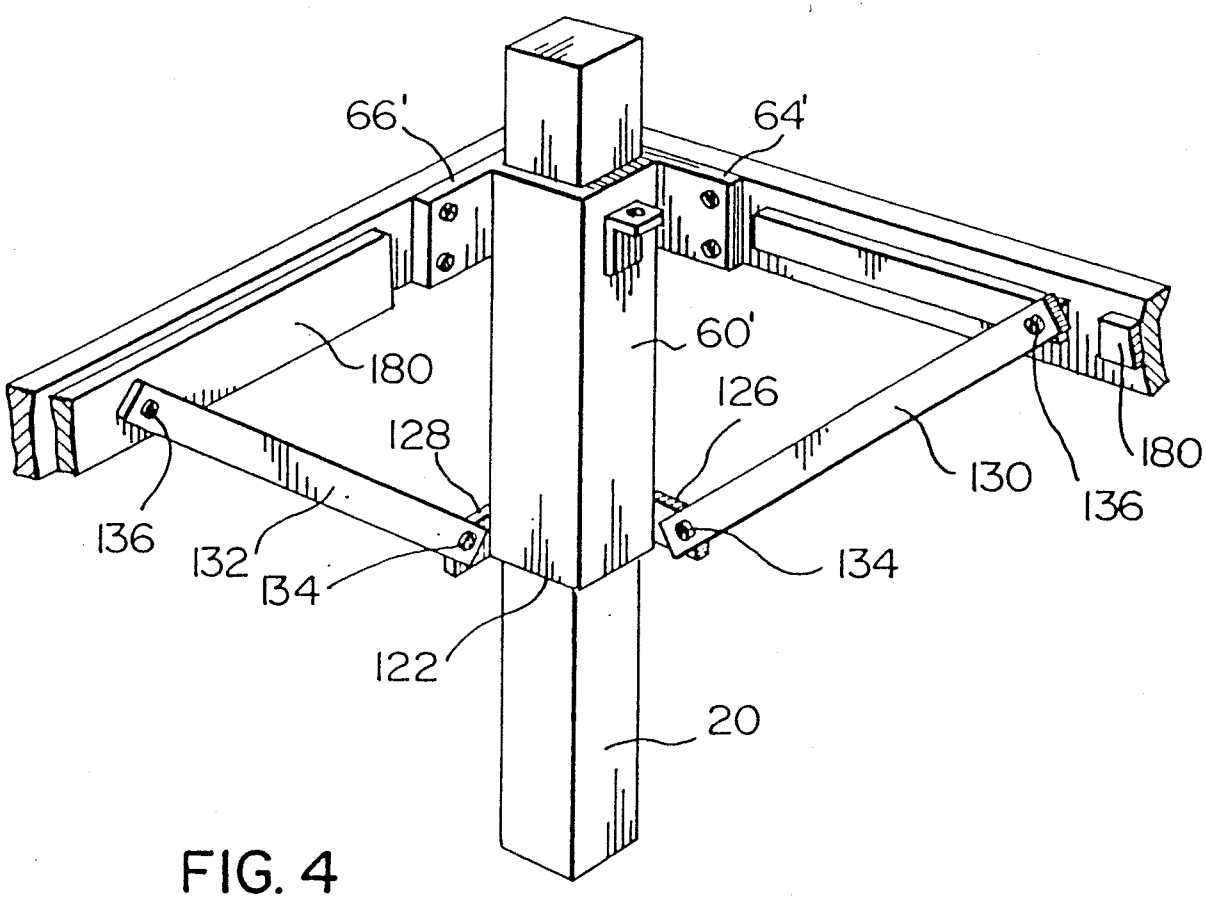
FIG. 4 is a perspective view of a modified bracket.

FIG. 4 shows a modification of bracket 60 particularly for use as an outer end or front bracket because of the depth of the water (see FIG. 2). Front bracket 60' is substantially identical to bracket 60 (there would also be a mirror imaged bracket similar to **60*a*) in all the essential features. The exceptions are that bracket 60' is of greater vertical extent than bracket 60 and extends further down legs 22, preferably a distance of about two feet. The lower end 122 of bracket 60' has welded thereto, lugs or plates 126, 128, which are angled upwardly from frame 62' with the outer surface of the plates respectively generally planar with outer surfaces 64' and 66'. Supports 130 and 132 may be secured to brackets 126, 128 through a bolt and nut connection 134 and secured to dock frame members 50 and 52 by lag bolts 136** extending through appropriate apertures (not shown) in such members.

In assembling and installing my dock system, ramp 12 and section 14 are secured together at 150 with a nut and bolt system or the like (not shown), through confronting end members 52 and floated out perpendicular to shoreline 152. If the dock is less than 6 ft. wide or has removable panels or slats which are not in place, the installer would then use a boat to insert the four legs 20 into the appropriate brackets 60 (**60*a*) or 60' of section 14. If section 14 has planking or otherwise has panels fixed thereto, section 14 would float sufficiently that the installer could stand on section 14 while inserting the four legs 22. In either event, when the bottom of the legs contact the bottom of the lake or river the lifting mechanism is installed. More specifically, referring to FIG. 3, the ends 112 of lag bolts 110 are inserted into aperture 82 of lug 80 and bolt 110 turned upwardly so it is parallel with the adjacent leg 20. The upper end of bolt 110 is then inserted in aperture 102 of header 90 and lag nut 114 with handle 116 is connected to the end of bolt 110. Header 90 is preferably tack nailed to leg 22 by a common 3½ nail or double head nail through aperture 98. The lag nut is tightened to take the weight of the section, i.e. transferring weight of section to leg 20. The upper surface of the frame section is preferably set about 1" off the water at this time. Once all four lift mechanisms are in place, the second section 16 is floated out and bolted into place to the first section. In FIG. 1, section 16 is bolted to the outer end of one of the side members 50 to form an "L" shaped dock. It will be appreciated however that section 16 could be bolted to the end section 14 to extend the dock straight out from shore. Section 16 can be bolted to section 14 while kneeling on leg supported section 14. Legs 22 are then inserted into appropriate brackets 60 (or 60') of section 16 and lifting mechanisms 61 are installed in the manner noted above. The lift mechanisms 61 (header 90, lag bolt 110, and lag nut handle 116) are operated sufficiently so legs 22 of section 16 take the weight of the end of section 16 and its upper surface is also about 1" above the water and level with the deck surface of section 14**.

Once all sections (e.g. 14, 16) and the lifting mechanisms 61 are in place on the various legs 20, 22, the lift mechanisms 61 are successively incremented upwardly by rotation of the respective handle 116 in 2" stages until the desired level of the section is reached.

Once the desired level of the dock is reached, each bracket 60 (60') and **60*a* is locked to the associated leg 20 or 22 by using 2–3½ common nails 160 leaving about a 1" head for later removal. The nails 160 shown in dotted lines in FIG. 3, are located in holes 88 of frame 60** and secured as indicated to leave a head for later removal as desired or necessary. The length of the nail chosen obviously depends on loading requirements. Alternatively lag bolts or pins can be used depending on load requirements.

Temporary nail in hole 98 of bracket 90 is removed and the leg lifting assembly 61 comprising header 90, lag bolts 110, lag nut 114 and handle 116 are then removed and stored for later use in dismantling the dock. With the dock structure in place, the decking, if removable, in the form of individual planks or decking sections, are placed on the several dock sections 14, 16, etc. and the dock is operational.

If a variation in water level, either up or down requires the surface of the dock to be adjusted, the same procedure may be used to move the several sections 14, 16 up or down in the same 2" increments to set the dock surface at the desired level relative to the water level.

In dismantling the dock for winter, the lifting mechanisms are installed by removing any decking or planking necessary to permit connection of the lag bolt 110 to lug 80 (or 80') of each leg 20, 22 and a header 90 is located on each leg 20, 22 and assembled with the associated lag bolt 110 (tack nailed for safety). An handle 116 with nut 114 is assembled to each bolt 110 and rotated until the weight of the dock adjacent to leg is taken up by the associated lifting mechanism. Once the weight of all sections has been taken up by the respective lifting mechanism and legs, all the common nails or double headed nails 120 are removed and the frame sections lowered a 2" increment until the frames are floating in the water. If the decking is fixed or still on the section, the sections will float sufficiently to support a man to then disconnect the headers and lag bolts and unbolt the sections from each other so that each frame section may be pulled up on shore and stored for the winter. If decking has been removed, the dismantler may perform the above from a boat without difficulty.

When the front end or deep water box frame 60' is used (FIG. 4), it will be obvious such sections are stored on shore upside down.

Box frames 60, 60' are configured to ride up and down on legs 20, 22 and it will be appreciated that some degree of freedom, i.e. a loose fit will permit movement without binding and yet maintain a strong sturdy structure. The increments of movement, i.e. 2" for raising and lowering the sections about each leg may vary from dock to dock depending on the fit between legs and box frame and the size of each dock section.

It will be apparent to those skilled in the art that the repeated increments of raising the lowering the section adjacent each leg is such to avoid binding and to maintain the dock generally level at all times.

Figure 5:
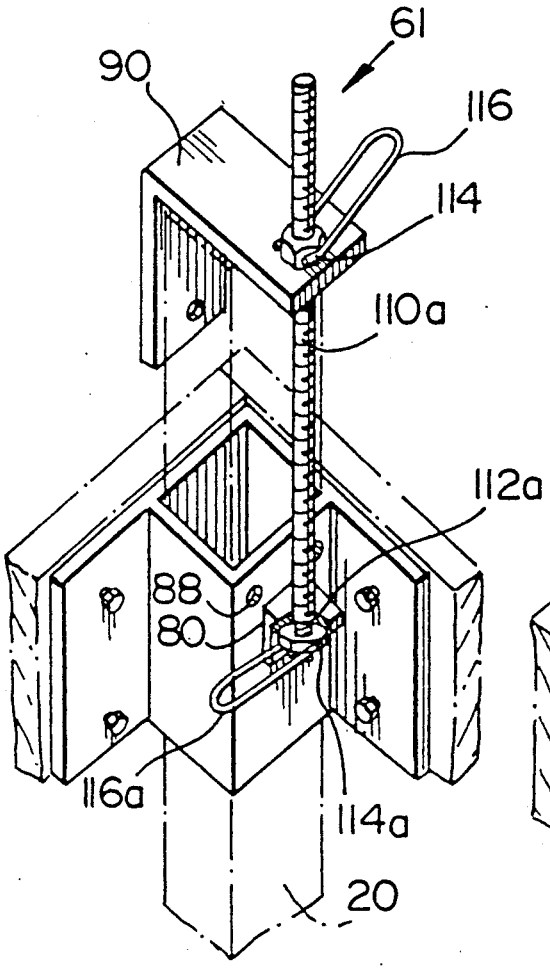
FIG. 5 is a perspective view partly in section showing a modification of the invention.

Turning to FIG. 5, I show a variation in the lifting mechanism wherein a second lag nut/handle **114*a*/116*a* is used on a lag bolt 110*a* at the bottom, the bolt 110*a* having a straight end rather than one angled such as 112 in FIG. 5. Once the straight end 112*a* is inserted through lug aperture 82*a*, it is screwed into nut 114*a* held by the installer or dismantler. Rotation of the upper handle 116 will cause the lower handle 116*a* to contact the box frame 60, 60' and permit continued rotation of the upper nut relative to bolt 110*a***.

Figure 6:
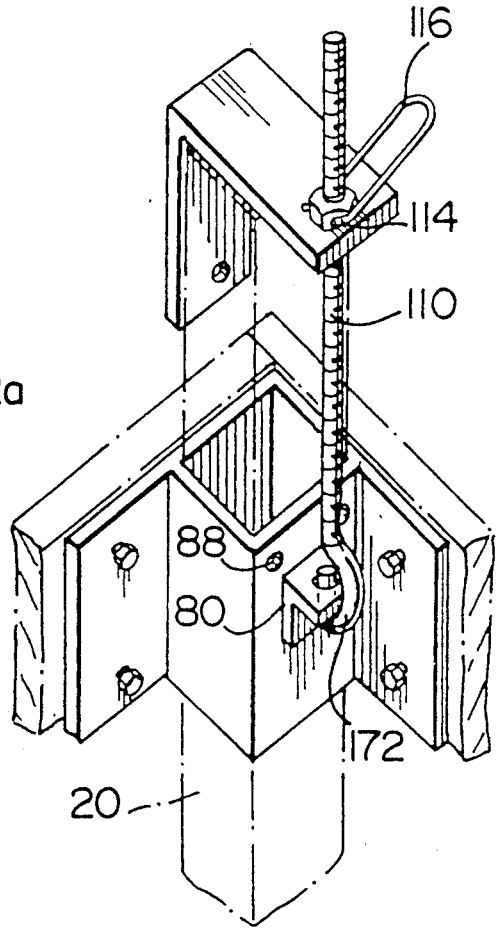
FIG. 6 is a perspective view showing a further modification of the invention.

FIG. 6 shows a variation in the lag bolt construction which permits easy connection between the lug **80*b* and lag bolt 110*b*. The lag bolt has a hook end 172** formed or otherwise connected by welding to the end thereof.

It is well known that wood sized as 4"×4" does not have a dressed size of four inches by four inches. Although the sizing may be $3\frac{5}{8}$"×$3\frac{5}{8}$", some variations often occur which may cause unnecessary gaps between the sides of the box girder and the side of the wooden support legs when in operative association together. Accordingly, FIGS. 7–9 illustrate variations to the previous embodiments wherein some adjustment to the cross-sectional dimensions of the box girder is possible in order to permit a relatively secure fit between the box girder and the leg support and yet permit relative movement between the girder leg when desired.

Figure 7:
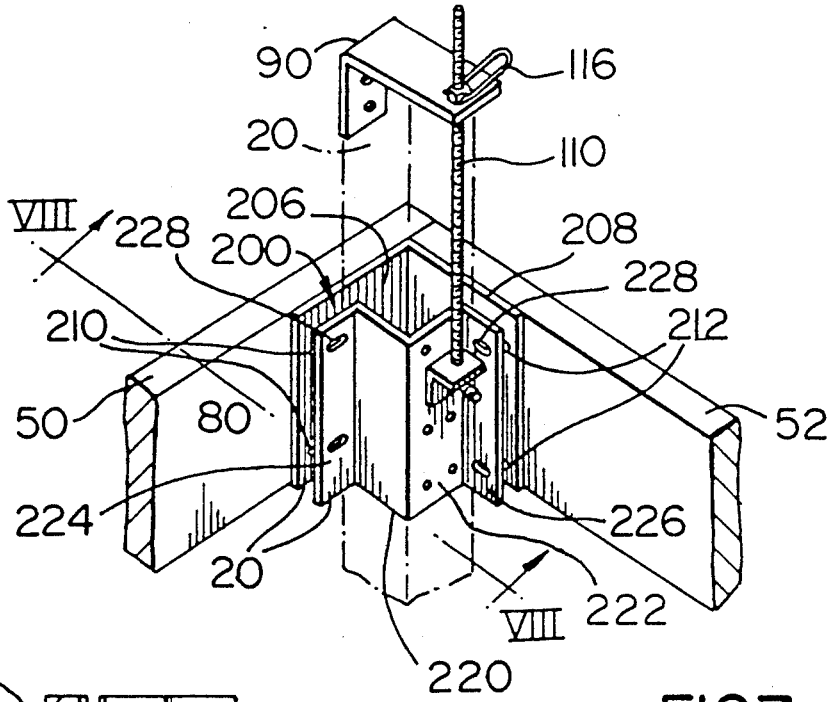
FIGS. 7 and 8 illustrate a variation in the construction of the box girder of FIG. 3, FIG. 8 being a sectional view along line 8—8 of FIG. 7.
Figure 8:
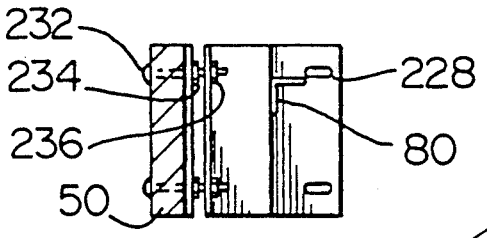
Figure 9:
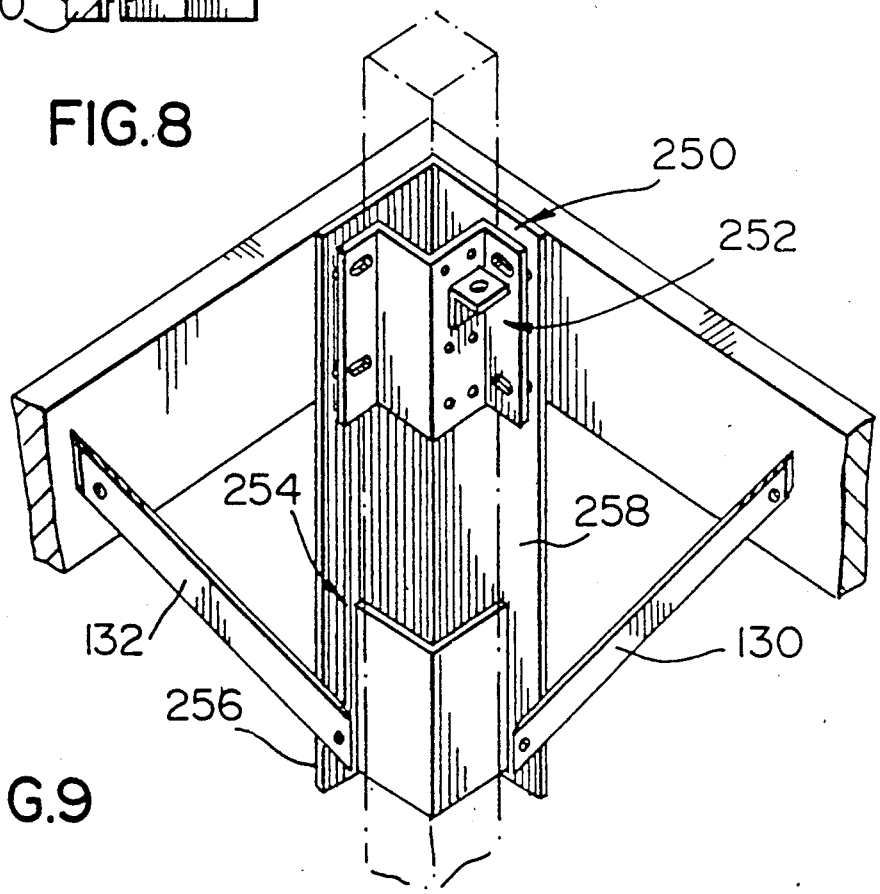
FIG. 9 illustrates a variation in the construction of the box girder of FIG. 4.

Turning to FIGS. 7 and 8, like numbers indicate the same features as are shown in FIG. 3. Box girder 200 comprises two parts 202 and 204, part 204 itself comprising a right angle element having wing portions 206 and 208 with apertures 210, 212 in each wing portion. Part 202 is of right angle configuration having sides 220, 222 with flanges 224 and 226 each extending at right angles to the respective sides 220, 222. Flanges 22, 226 have oval aperatures 228, 230 adapted to be generally aligned with aperatures 210, 212 respectively.

Suitable carriage bolts 232 and nuts 234, 236 (FIG. 8) are used to secure wing portions 206, 208 to frame members 50 and 52 and to secure flanges 224, 226 to confronting portions of wings 206, 208.

It will be apparent that the lateral sizing of sides 220, 222 may be such that part 202 may be bolted to part 204 to confine a leg support 20 such that the leg does not wobble within the box girder 200 but it still is axially movable therethrough. It is not intended that the ability to size the box girder 200 removes the necessity of using nails 160 to secure the box girder at the appropriate and selected height but only to provide a reasonable close fit between the leg and girder.

Turning to FIG. 9, it will be apparent that box girder 250 has an upper sizing section 252 similar to that shown in FIGS. 7 and 8. Lower section 254 is separate from the upper section 252 with wings 256, 258 continuous from top to bottom and providing the equivalent of lugs 126, 128 (FIG. 4) at the lower end of the girder for securing reinforcing members 130, 132.

It will be appreciated that the lower section 254 may be designed for adjustability and once set, need not be altered provided the box girder can move axially relative to the leg support.

Although I have not shown deck planking on the frame, it will be apparent that any form of planking permanently or removably secured is contemplated, the only limitation being that the planking adjacent the ends of the sections must be removable in order to gain appropriate access to lug 80, **80*a*, etc. and to install and remove nails 160 or the like. I have shown removable deck supporting beams 180 fastened to frames 50 in FIGS. 3 and 4 and beam 54 (FIG. 1) provides additional support for such decking. The space adjacent each end frame 52 may be fitted with a plank supported on beam 54 and constructed to rest on lugs 80, 80*a*. However, the form of the deck or planking or whether it is fixedly secured to frame members 50, 52 or removably secured is not critical to the invention provided that in any system of decking, access be provided to lugs 80 (80*a*) and nails 160**.

Accordingly I have provided a simple but effective means of installing and dismantling a platform in the form of a dock using wood which is still considered desirable in view of its aesthetic appearance and its cost effective availability.

It will be apparent that even though I have described my invention in regard to a preferred embodiment of a dock system, it is equally adapted to use in raising and lowering platforms or sections of platforms or for constructing and levelling patio decks, stages and other forms of support platforms or structures such as small bridges over creeks, streams or gullies.

Accordingly, although a preferred embodiment has been shown and described in detail, various modifications and changes in addition to those noted, may be made therein without departing from the spirit and scope of the invention as defined in the appended claims.

The embodiments of the invention in which an exclusive property or privilege is claimed are defined as follows:

1. Apparatus for raising and lowering a platform having wooden leg support means, comprising:

a box girder adapted to move axially about a wooden support leg of a platform, said box girder having means for securement of said girder to material to be used in forming the frame of said platform, said box girder having lug means on an exterior surface thereof;

header means for detachable assembly with the top of a support leg of said platform during raising or lowering of said platform frame to a desired level; and, screw means for operative association with said header means and said lug means for selectively raising or lowering said girder about said leg relative to said leg support means.

2. The apparatus of claim 1 wherein said screw means comprises an elongate lag bolt with means at one end for detachable connection with said girder lug means and threaded at the other end, and rotatable nut means for operative association with said threaded end.

3. The apparatus of claim 2 wherein said lug means has an aperture and said detachable connection means includes said one end of said lag bolt being substantially at right angles to the axis of said bolt.

4. The apparatus of claim 2 wherein said lug means has an aperture and said detachable connection means includes a nut assembly including handle means to control its rotation.

5. The apparatus of claim 2 wherein said header comprises a right angled element having a portion adapted for contact with the top of a leg and a downwardly extending portion for detachable connection with a side of the leg, said top leg portion of said element having an aperture adapted to accept the other end of said lag bolt.

6. The apparatus of claim 1 wherein said box girder has an axial length at least as great as the width of the frame member with which it is to be used, said girder also having wing elements for securement to such frame member in forming a corner of a platform.

7. The apparatus of claim 6 wherein the axial length of said box girder is longer than the width of the frame member with which it is to be used, the wing elements being at one end of said box girder, the other end of said box girder having wing lug means to which additional structural supports may be connected to rigidify said corner.

8. The apparatus of claim 1, wherein the cross-sectional size of the box girder is adjustable.

9. The apparatus of claim 6 wherein the axial length of said box girder is longer than the width of such frame member with which it is to be used, the wing element extending the length of said box girder, said box girder having an upper section wherein the cross-sectional configuration is adjustable.

10. The apparatus of claim 9, wherein the box girder includes a lower section of fixed cross-sectional configuration.

11. A method of raising a platform comprising the steps of:

providing a platform with a frame having secured thereto a plurality of box girders, each box girder having an opening adapted to accept in generally vertical telescoping fashion a wooden leg structure, said box girders each having apertured lug means secured thereto;

inserting a wooden leg structure into each said girder;

detachably connecting one end of an elongate bolt means to each said lug means, the other end of said bolt means being threaded;

inserting the threaded end of each said bolt means through an aperture in a header and detachably locating said header on the top of a leg structure;

threadedly attaching a nut assembly having handle means to the threaded end of each bolt means;

rotating each said nut assembly whereby each respective box girder is raised on the associated leg to a desired height;

fixing each girder to the respective leg structure; and removing each said header and bolt means.

12. In a method of raising or lowering a platform having a plurality of leg structures adapted for telescopic association with a plurality of box girders connected to frame members of a platform, each said box girder having an apertured lug means associated therewith, and wherein said girders and leg structures may be detachably secured together at selected heights, the steps comprising:

connecting one end of a lag bolt to each girder lug means;

telescopingly connecting the opposite threaded end of the lag bolt to a respective header plate associated with the top of each leg;

connecting a nut assembly with the threaded end of said lag bolt; and rotating the nut assembly whereby the weight of the adjacent frame member is assumed by the associated leg structure.

13. The method of claim 12 wherein the platform is to be raised, further comprising the steps of:

rotating each nut assembly in a direction to incrementally raise the associated box girder until the desired level of the platform is reached;

securing each box girder to said associated leg structure;

removing each nut assembly, header plate and lag bolt from each leg structure.

14. The method of claim 12 wherein first height and is to be raised to a second height comprising the additional steps of:

removing means securing each said box girder to said associated leg structure;

rotating each said nut assembly in a direction to incrementally raise the associated box girder until the desired second height of the platform is reached;

again securing each box girder to said associated leg structure;

removing the nut assembly, header plate and lag bolt from each leg structure.

15. The method of claim 12 wherein the platform is at a first height and is to be dismantled, further comprising the steps of:

removing means securing each said box girder to said associated leg structure;

rotating each said nut assembly in a direction to incrementally lower the associated box girder, said platform being lowered to a supporting surface;

removing each nut assembly and lag bolt from each leg structure; and storing said platform and legs as desired.

16. The method of claim 12 wherein the platform is at a first height and is to be lowered to a second height comprising a the additional steps of:

removing means securing each said box girder to said associated leg structure;

rotating each said nut assembly in a direction to incrementally lower the associated box girder until the desired second height of the platform is reached;

again securing each box girder to said associated leg structure;

removing the nut assembly, header plate and lag bolt from each leg structure.

17. In a platform support system having a platform frame including frame members and leg support means for supporting said frame, apparatus for selectively raising, lowering and supporting the frame comprising:

a box girder secured to at least one frame member, said box girder having a bore therethrough with an axis generally perpendicular to said frame member;

means for detachably securing said box girder along said leg support means at a selective height;

said box girder having lug means;

header means for detachable assembly with an upper end of said leg support means;

screw means for operative detachable connection between said detachable header means and said lug means whereby the relative position of said frame means to said leg support means may be adjusted prior to securing said box girder to said leg support means.

18. The support system of claim 17 wherein said screw means comprises an elongate lag bolt with means at one end for detachable connection with said girder lug means and threaded at the other end, and rotatable nut means for operative association with said threaded end.

19. The support system of claim 18 wherein said lug means has an aperture and said detachable connection means includes said one end of said lug bolt being substantially at right angles to the axis of said bolt.

20. The support system of claim 18 wherein said lug means has an aperture and said detachable connection means includes a nut assembly including handle means to control its rotation.

* * * * *